United States Patent [19]

Turunen

[11] 4,055,461

[45] Oct. 25, 1977

[54] PAPER MACHINE WITH SINGLE-WIRE AND CURVED TWIN-WIRE FORMERS

[75] Inventor: Risto Turunen, Jyvaskyla, Finland

[73] Assignee: Valmet Oy, Finland

[21] Appl. No.: 723,225

[22] Filed: Sept. 15, 1976

[30] Foreign Application Priority Data

Sept. 17, 1975 Finland ..... 752603

[51] Int. Cl.[2] ..... D21F 9/00

[52] U.S. Cl. ..... 162/290; 162/301; 162/305; 162/306; 162/359; 162/360 R

[58] Field of Search ..... 162/290, 300, 301, 305, 162/306, 317, 350, 351, 359, 360 R, 203, 206, 217

[56] References Cited

U.S. PATENT DOCUMENTS

| | | | |
|---|---|---|---|
| 3,846,232 | 11/1974 | Kankaanpaa | 162/301 |
| 3,891,500 | 6/1975 | Kankaanpaa | 162/290 X |
| 3,981,084 | 9/1976 | Sobota | 162/290 X |
| 3,985,612 | 10/1976 | Watanabe | 162/203 |
| 3,997,390 | 12/1976 | Kankaanpaa | 162/203 X |

*Primary Examiner*—Richard V. Fisher
*Attorney, Agent, or Firm*—Steinberg & Blake

[57] ABSTRACT

A paper machine, particularly adapted for manufacturing tissue paper, has inner and outer endless fabrics, each in the form of a wire or felt, guided around a smooth forming roll where the inner fabric is situated next to the forming roll between the latter and the outer fabric to define at the forming roll a curved twin-wire former. The outer fabric has an elongated portion situated in advance of the twin-wire former and spaced from the inner fabric to form a single-wire former which receives stock from a headbox and with which a suitable dewatering structure cooperates so that a considerable amount of water has been removed from the web forming on the single-wire former by the time the web reaches the twin-wire former. At the end of the twin-wire former distant from the single-wire former, the inner and outer fabrics are separated from each other and the web is transferred to the inner fabric by way of the normal table roll effect between the inner fabric and the smooth forming roll. At a part of the inner fabric which is distant from the smooth forming roll there is a pick-up structure for picking up the web from the inner fabric and directing the web to the press and dryer sections of the machine.

2 Claims, 1 Drawing Figure

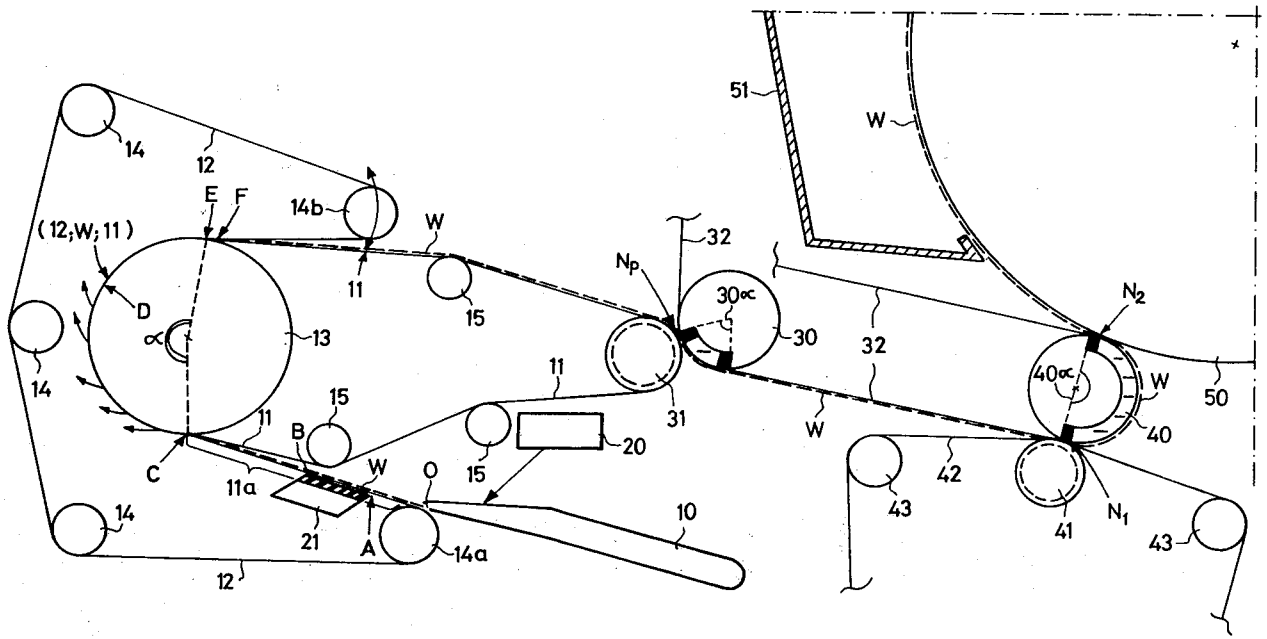
50
W
40
N2
N1
40α
41
43
42
43
W
32
W
30
30α
51
32
31
Np
10
20
11
15
15
14a
O
W
A
21
11a
12
15
B
11
13
C
14
14
14
14b
11
W
15
E
F
12
D
α
(12;W;11)

PAPER MACHINE WITH SINGLE-WIRE AND CURVED TWIN-WIRE FORMERS

BACKGROUND OF THE INVENTION

The present invention relates to paper machines.

In particular, the present invention relates to paper machines particularly suited for manufacturing tissue paper.

The former section of the machine of the invention includes a smooth forming roll around which inner and outer endless fabric means, each in the form of a wire or felt, are guided to define at this forming roll a twin-wire former wherein the inner fabric means is situated between the smooth forming roll and the outer fabric, with dewatering of the web taking place at the twin-wire former primarily as a result of centrifugal force while the web is sandwiched and compressed between the inner and outer endles fabric means, the machine preferably having a hydraulic headbox.

It is known to manufacture tissue paper by forming a web on a fairly short wire section resembling a normal planar wire where a headbox applies the pulp stock onto a breast roll, which frequently has an open interior and is provided with an internal suction. In such machines the web travels while supported on the wire past conventional dewatering elements such as table rolls, deflectors, foil lathes, suction boxes, and a suction roll, each of which removes water from the stock web. At the discharge end of the wire section the partially dried web is transferred onto a so-called pick-up felt which supports and conveys the web to undergo further drying in the press and dryer sections of the machine.

In certain known machines the above planar wire has been entirely omitted. With constructions of this type the formation of the web takes place entirely on the suction breast roll which is wire-coated and from which the web is transferred directly onto the pick-up felt.

With constructions as referred to above, there is the drawback, among others, that the upper speed limit of the paper machine will be approximately 1500 m/min, because the draining pressure reaches such a great value that it causes the web to adhere undersirably to the wire, with consequent difficulties of the detachment of the web from the wire.

There are several known twin-wire formers intended for the manufacture of tissue paper. Most of these twin-wire formers are so-called full throat formers, but these structures have in general the drawback that as a result of the throat- forming process only a poor web formation is achieved. With such constructions difficulties are encountered in transferring the web onto the transporting wire. Also, control of dewatering is difficult.

With respect to patent literature pertinent to the present invention, reference may be made, by way of example, to Canadian Pat. No. 968,601, in which a certain type of pick-up press is disclosed, in the general field of the present invention. Reference also may be made to U.S. Pat. Nos. 3,378,435 and 3,537,954, of which the first provides the so-called Crescent former. Closely related to these patents are U.S. patent application Ser. No. 730,444 filed May 20, 1968. Also, reference may be made to British Pat. No. 1,244,040, in which the so-called Papriformer of AB Karlstads Mekaniska Verkstad is disclosed.

The present invention is a further development of what is shown in U.S. Pat. No. 3,846,232 and U.S. application Ser. No. 493,704 filed July 31, 1974, now U.S. Pat. No. 3,997,390. With respect to these constructions reference may be primarily made to the single-wire initial part of the former disclosed therein, as well as to the possibilities of controlling different process variables in a manner to which the practical papermaker is already accustomed on Fourdrinier paper machines. In this connection, the most important of these process variables are the speed of discharge of the stock jet relative to the speed of travel of the wire, the angle at which the stock jet meets the wire, and the rate at which water is drained from the suspension deposited on the wire.

SUMMARY OF THE INVENTION

It is a primary object of the present invention to provide improvements in tissue paper machines of the above type, particularly at the former sections thereof.

More specifically, it is an object of the invention to provide a former section wherein lower draining pressures than could heretofore be attained may be utilized at the initial stage of the web-forming process. At the final stage of the web-forming process, where the escaping quantities of water are smaller, the draining pressure may be increased. In this way detaching of the web from one of the fabrics of the twin-wire former section is facilitated.

Another object of the present invention is to provide a paper machine, particularly a tissue paper machine, wherein the softness and resiliency of the paper, particularly important in tissue paper, are preserved to the greatest possible extent in the web.

Yet another object of the present invention is to improve the extent to which fibers and filler substances are retained while at the same time receiving the highest possible splitting strength of the finished paper.

The object of the present invention also include the provision of a former wherein the dry matter content is higher than has heretofore been possible, prior to the drying operation, provision of a paper machine structure which is simple and of low cost, with this particular objective being achieved by a construction wherein the least possible number of expensive suction rolls and of elements subjected to frictional rubbing are required.

Furthermore, it is an object of the present invention to provide a paper machine wherein the least possible extent of marking of the paper from the wire and suction rolls is incurred.

In addition it is an object of the present invention to provide a reduction in the power consumption and to attain a control of the draining pressure in such a way that it is possible to achieve a higher running speed for the machine than was heretofore possible.

According to the invention, in order to reduce the draining pressure of the former section at the initial stage of web formation, the draining region is lengthened by providing it with a single-wire initial web-forming part formed by a portion of an endless outer fabric means which is lapped together with an inner endless fabric means around a smooth forming roll where these inner and outer endless fabric means form a twin-wire former. This elongated initial part of the outer endless fabric means which forms the single-wire former cooperates with a dewatering means situated within the loop of the outer endless fabric means and taking the form of a suitable forming board or other equivalent means or a group of such means. After the web which has been dried during web formation at the single-wire initial web-forming section and while travelling through the twin-wire section, is transferred onto the upper surface of the inner endless fabric means where the latter travels beyond the smooth forming roll, this transfer taking place as a result of the normal table roll effect, the web is delivered to a pick-up means. As a result of the fact that the dry matter content of the web formed in the above matter is relatively high, it is possible to transfer the web from the twin-wire former section to the inner endless fabric means where it travels beyond the smooth forming roll, as a result of the normal table roll effect at a higher speed than has heretofore been possible.

BRIEF DESCRIPTION OF DRAWINGS

The invention is illustrated by way of example in the accompanying drawing which forms part of this application and in which one possible embodiment of the invention is illustrated in a schematic and partly fragmentary manner.

DESCRIPTION OF A PREFERRED EMBODIMENT

Referring now to the drawing, the former section of the illustrated paper machine includes the schematically illustrated hydraulic headbox 10 and a curved twin-wire former section, the curvature of which is determined by a smooth-surfaced forming roll 13. The twin-wire former includes an outer endless fabric means 12, which may take the form of a suitable wire or felt, and an inner endless fabric means 11, which also may take either of a wire or a felt. The outer endless fabric means 12 is guided by a plurality of rolls 14, while the inner endless fabric means 11 is guided by a plurality of rolls 15. The web W which is formed with the illustrated paper machine is indicated by a dotted line. In the case where the inner and outer endless fabric means 11 and 12 are in the form of felts, suitable reconditioning means, which are not illustrated, may be provided for the felts.

In order to provide a draining region which is longer than has heretofore been provided at the initial stage of web-formation, the former includes a single-wire initial part formed by the elongated portion 11*a* of the endless fabric means 12, this elongated portion 11*a* travelling together with the endless fabric means 11 toward the roll 13 where the inner and outer endless fabric means meet to form the initial part of the twin-wire former at the location C indicated in the drawing. The pair of endless fabric means 11 and 12 are tangent to the forming roll 13 at this point C. The elongated initial single-wire former section 11*a* extends from the breast roll 14*a* up to the point C. Thus, this elongated initial single-wire section extends from the point O up to the point C.

At this initial single-wire web-forming part of the illustrated machine, forming a draining region for the initial web formation, there is within the loop of the endless fabric means 12 a dewatering means which in the illustrated example takes the form of the illustrated forming board 21. This dewatering means promotes the dewatering action during travel of the web W from point A to point B, in a well known manner as a result of the foil effect and/or suction.

The headbox means 10 of course deposits the suspension onto the initial single-wire section 11*a* at the point O. A suitable control means 20 has been schematically illustrated, this control means 20 being provided for adjusting the magnitude of the lip slice of the headbox 10 as well as its direction with respect to the initial single-wire section 11*a*. In this way suitable controls during initial web formation are achieved.

As is illustrated in the drawing, the inner endless fabric means 11 and the outer endless fabric means 12 are lapped around the smooth forming roll 13 through the illustrated angle $\alpha$ to form a curved twin-wire former wherein the inner endless fabric means 11 is situated next to the forming roll 13 between the latter and the outer endless fabric means 12. Of course the web W is compacted between the inner and outer endless fabric means as the web travels along the illustrated curved twin-wire former which extends around the roll 13. At the region of the twin-wire former, which includes the region D extending throughout the length of the twin-wire former from the point C up to the end at the region at the point E or the point F of the illustrated structure, dewatering takes place primarily as a result of the drainage pressure generated by centrifugal force (kinetic energy). The angle $\alpha$ around which the roll 13 is lapped by the inner and outer endless fabric means 11 and 12 to form the twin-wire section therefrom is preferably on the order of 180°.

With respect to the rolls which guide the endless fabric means 12, at least the upper right roll 14*b* is adjustable, as indicated by the curved-double-headed arrow, for situating the discharge end of the twin-wire former at the region of the point E or F and for controlling in this way the extent of vacuum prevailing at the upper tangential point of the pair of endless fabric means 11 and 12 with respect to the forming roll 13 (at the region of the points E, F). By adjusting the degree of vacuum at this location it is possible to influence the detachment of the web W from the outer endless fabric means 12 so that the web W will reliably travel together with the inner endless fabric means 11 laterally beyond the forming roll 13, the web at this time being carried by the upper surface of the substantially horizontal upper run of the endless fabric means 11. Such a reliable web transfer without utilizing a separate suction means cannot be achieved with full-throat formers of previously known machines. This latter vacuum which serves to transfer the web reliably from the outer endless fabric means 12 so that it remains with the inner endless fabric means 11 is brought about by way of the normal table roll effect. Research into the action of table rolls has shown that the roll rotating in contact with the underside of the wire creates a vacuum at the outgoing nip. In conventional Fourdriniers, the effect this suction is to increase the drainage of the water through the wire at the downstream side of each table roll. Thus, this same type of suction is achieved by the cooperation of the smooth forming roll 13 with the underside of the inner endless fabric means 11 at the region of the point E or F, providing in this way reliable transfer of the web to the upper surface of the upper run of the endless fabric means 11 due to this table roll effect.

In the embodiment illustrated in FIG. 1, the endless fabric means 11 may be in the form of a wire, and the transfer of the web W to the press section of the machine requires the use of a pick-up means. This pick-up means includes within the loop of the wire 11 a grooved roll 31 forming part of a pick-up means which includes also the pick-up suction roll 30 which has a suitable suction means at the suction zone 30 $\alpha$ . The pick-up means also includes the pick-up felt 32 which travels through the pick-up nip $N_p$ defined between the rolls 30 and 31. Thus, the endless fabric means 11 travels with the web W to the pick-up nip $N_p$, where the web is detached from the fabric means 11 to continue to travel with the pick-up felt 32 as a result of the action of the suction means of the roll 30 at the location 30 $\alpha$.

In this way the web adheres to the lower surface of the felt 32 in order to be transported thereby to the first press nip $N_1$ of the press section of the illustrated machine. In order to maintain the soft and fluffy nature of the tissue paper, the lowest possible lineal pressure is utilized at the pick-up press nip $N_p$.

The press section of the illustrated tissue machine includes at the first press nip $N_1$ a lower press roll 41 having a recessed surface and an upper press roll 40 provided with a suction means at the suction zone 40 $\alpha$. Thus, the suction zone 40 $\alpha$ extends approximately through the right half of the upper press roll 40, as viewed in the drawing. The press section also includes a lower felt 42 guided by the illustrated rolls 43 and travelling through the first press nip $N_1$ defined between the pair of press rolls 40 and 41. Of course the pick-up felt 32 travels together with the web also through the first press nip $N_1$ where the web is sandwiched between the lower felt 42 and the pick-up felt 32, the latter travelling together with the web around approximately the right half of the upper press roll 40 where the suction prevails.

From this first press nip $N_1$, the web W travels, while remaining attached to the upper felt 32, along the suction zone 40 of the roll 40 to the second press nip $N_2$. This second press nip $N_2$ is defined between the fragmentarily and schematically illustrated Yankee cylinder 50 and the upper press roll 40, this Yankee cylinder 50 forming part of the dryer section of the machine in a well known manner. Thus, the felt 32 together with the web W travels all the way up to the second press nip $N_2$ defined between the Yankee cylinder 50 and the upper press roll 40, and beyond the press nip $N_2$ the web will remain in engagement with the Yankee cylinder 50 while the drying operations go forward.

In the embodiment of the invention which is illustrated, only one press nip $N_2$ is provided in connection with the Yankee cylinder 50. In this way, the hood 51 which cooperates with the Yankee cylinder 50 in a well known manner can be extended so as to cover the cylinder 50 to an extent considerably greater than has heretofore been possible. Thus, because of the provision of a press section having only the press nips $N_1$ and $N_2$, with only one press nip $N_2$ being provided at the Yankee cylinder 50, the hood 51 may be extended all the way up to the region of the press nip $N_2$ or in other words up to the region of the upper press roll 40, in this way achieving a better heat economy in connection with the Yankee cylinder. It is possible with the structure of the invention to omit the second Yankee press, as a result of the fact that with the above structure in the press section there is an efficient as a well as a two-sided dewatering action.

By way of the present invention it is thus possible to provide a longer draining region than has heretofore been possible, as a result of the single-wire initial part 11*a* of the draining region. Accordingly, at the point where in prior art formers web formation only starts, with the former of the present invention 20–40% of the water has already escaped from the web W. The draining pressure which is provided beyond the single-wire former is directly proportional to the tension of the outer endless fabric means and inversely proportional to the radius of the roll 13. Inasmuch as the amount of dewatering required at the final stage of web formation is less with the present invention than has heretofore been possible, the draining pressure may be increased by making the radius of the roll 13 smaller than would otherwise be possible. The result is that the web has a relatively high dry-matter content, thus enabling the table roll effect to be utilized at the transfer of the web onto the upper run of the endless fabric means 11. In addition, increasing the dry-matter content reduces the required drying energy.

As is apparent from the above, in accordance with the invention the web has already formed to a great extent before it is impacted between the inner and outer endless fabric means 11 and 12 at the twin-wire former section defined thereby. In this way a superior web formation is achieved. Moreover, it is easier to transfer the web both at the point of detachment from the endless fabric means 12, namely at the point E, F, and at the actual pick-up point $N_p$. This result is achieved primarily because at the initial stage of web formation smaller draining pressures are utilized than has heretofore been possible so that the web "grows"to a lesser extent than has heretofore been possible into the meshes of the endless fabric means 12 to become intermeshed therewith. Thus, while a highly effective draining is achieved at the initial stage of web formation on the single-wire former, nevertheless the rate of drainage at this initial stage is reduced as compared to previously known machines.

The adjustability of the operations at the initial part of the forming region, brought about by way of the control means 20, enables the apparatus to be adapted to all and any types of tissue paper manufacture.

Many of the above details may vary widely while still remaining within the inventive concept defined by the claims which follow.

What is claimed is:

1. In a paper machine, inner and outer endless fabric means and a smooth forming roll around which said inner and outer fabric means are lapped with said inner endless fabric means situated between said outer endless fabric means and said forming roll and forming with said outer endless fabric means a twin-wire former where said inner and outer fabric means are lapped around said forming roll, said outer endless fabric means having an elongated portion situated in advance of the twin-wire former and spaced from said inner endless fabric means while travelling with the latter toward said smooth forming roll to meet said inner endless fabric means at said forming roll to form therewith the initial part of the twin-wire former, headbox means cooperating with said elongated portion of said outer endless fabric means which is situated in advance of said twin-wire former for depositing on said elongated portion of said outer endless fabric means stock which starts web formation on said elongated portion of said outer endless fabric means in the manner of a single-wire former so that the web has partially formed on said elongated portion of said outer endless fabric means prior to reaching the twin-wire former where the partially formed web is further compacted between the inner and outer endless fabric means, dewatering means cooperating with said elongated portion of said outer endless fabric means for draining water from the web formed on said elongated portion of said outer endless fabric means to an extent greater than if said dewatering means were not utilized, whereby the web reaches the twin-wire former in a condition according to which the web has dried to a substantial extent beyond that resulting only from gravitational watering at said elongated portion of said outer endless fabric means, with the drainage from the web being continued at the twin-wire former due to centrifugal force outwardly through the outer endless fabric means, whereby the web is gradually dried until reaching the end of the twin-wire former distant from said elongated portion of said outer endless fabric means, said inner and outer endless fabric means again becoming spaced from each other at the latter end of said twin-wire former and said smooth forming roll transferring the web to said inner endless fabric means for travel therewith beyond said twin-wire former due to the normal table roll effect, and pick-up means cooperating with said inner endless fabric means at a portion thereof distant from said smooth forming roll for picking up the web from said inner endless fabric means and directing the web along a path of travel to press and dryer sections of the paper machine, said pick-up means including a pair of rolls and a pick-up felt, said inner endless fabric means being guided around one of said pair of rolls while said pick-up felt is guided around the other of said pair of rolls and pressed thereby toward said inner endless fabric means for engaging the web thereon, said other of said pair of rolls including a suction means for detaching the web from said inner endless fabric means and transferring the web to said pick-up felt for travel therewith beyond said other of said pair of rolls, a pair of press rolls forming part of a press section of the paper machine and defining between themselves a first press nip, said pick-up felt travelling between said pair of press rolls for transporting the web to said first press nip, said pair of press rolls including an upper press roll around which said pick-up felt is guided and the other of said pair of press rolls being a lower press roll and having a recessed surface, the press section including a lower felt engaging said lower press roll and travelling through said first press nip together with the web and said pick-up felt, said upper press roll including a suction means causing the web to travel with said pick-up felt around said upper press roll while said lower felt travels by itself beyond said first press nip, the dryer section of the machine including a Yankee cylinder defining with said upper press roll a second press nip through which the pick-up felt travels for transferring the web in closed conduction up to said second press nip.

2. The combination of claim 1 and wherein the machine has only said first and second press nips, said dryer section of the machine including a hood into which said Yankee cylinder extends with said hood extending to the region of said second press nip.

* * * * *